US007690650B2

(12) United States Patent
Itoh et al.

(10) Patent No.: US 7,690,650 B2
(45) Date of Patent: Apr. 6, 2010

(54) SHEET TRANSPORTING DEVICE, AND AUTOMATIC DOCUMENT FEEDER AND IMAGE FORMING APPARATUS PROVIDED WITH THE SAME

(75) Inventors: Manabu Itoh, Nara (JP); Satoshi Murakami, Yamatokoriyama (JP); Kazumasa Tonami, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 63 days.

(21) Appl. No.: 11/933,546

(22) Filed: Nov. 1, 2007

(65) Prior Publication Data

US 2008/0111294 A1 May 15, 2008

(30) Foreign Application Priority Data

Nov. 9, 2006 (JP) ..... 2006-304250

(51) Int. Cl.
*B65H 7/12* (2006.01)

(52) U.S. Cl. ..... 271/263; 271/262; 271/265.04

(58) Field of Classification Search ..... 271/262, 271/263, 265.04
See application file for complete search history.

(56) References Cited

U.S. PATENT DOCUMENTS 5,029,837 A * 7/1991 Uchiyama ..... 271/110
5,098,078 A * 3/1992 Nakanishi ..... 271/10.11
5,174,562 A * 12/1992 Mizunaga et al. ..... 271/261
5,176,375 A * 1/1993 Kitahara ..... 271/10.05
5,222,423 A * 6/1993 Wadzinski ..... 83/88
6,129,351 A * 10/2000 Oohara et al. ..... 271/262
6,290,070 B1 * 9/2001 Graef et al. ..... 209/534
6,540,222 B2 * 4/2003 Araki et al. ..... 271/122
6,568,591 B2 * 5/2003 Modi ..... 235/379
6,623,001 B2 * 9/2003 Steinkogler et al. ..... 271/176
6,698,753 B2 * 3/2004 Chujo et al. ..... 271/262
6,761,352 B2 * 7/2004 Scicluna et al. ..... 271/153
6,782,986 B2 * 8/2004 Toda et al. ..... 194/206
7,347,417 B2 * 3/2008 Kutzer ..... 271/262
7,396,175 B2 * 7/2008 Ueda ..... 400/708
2002/0011431 A1 * 1/2002 Graef et al. ..... 209/534
2003/0006550 A1 * 1/2003 Chujo et al. ..... 271/262

(Continued)

FOREIGN PATENT DOCUMENTS

JP 2003-072988 3/2003

(Continued)

*Primary Examiner*—Patrick H Mackey
*Assistant Examiner*—Prasad V Gokhale
(74) *Attorney, Agent, or Firm*—Renner, Otto, Boisselle & Sklar, LLP

(57) ABSTRACT

A sheet transporting device including: a sheet feeding section that feeds sheets to a transporting path; a pair of upstream transporting rollers and a pair of downstream transporting rollers arranged with a predetermined space; a double feed detecting section that detects a length of a double feed portion; a determining section that determines whether the length of the double feed portion is shorter than the predetermined space or not; and a transport control section that controls the drives of the upstream transporting rollers and the downstream transporting rollers, wherein the transport control section controls speeds of the upstream transporting rollers and the downstream transporting rollers so as to separate the delaying sheet from the preceding sheet of the overlapped sheets, in a case where the determining section determines that the length of the double feed portion is shorter than the predetermined space.

10 Claims, 11 Drawing Sheets

L0: length of sheet

L1: length from upstream roller to downstream roller

L2: length from leading end of sheet to double feed area

L3: length of double feed

U.S. PATENT DOCUMENTS

2004/0265031 A1* 12/2004 Ueda ..... 400/636
2005/0140087 A1* 6/2005 Sano et al. ..... 271/276
2005/0184453 A1* 8/2005 Sano et al. ..... 271/262
2005/0228535 A1* 10/2005 Simonis et al. ..... 700/228
2006/0186594 A1* 8/2006 Mitsuya et al. ..... 271/262
2007/0018376 A1* 1/2007 Sano et al. ..... 271/10.01
2007/0081212 A1* 4/2007 Tonami et al. ..... 359/197

FOREIGN PATENT DOCUMENTS

JP 2004-323143 11/2004
JP 2006-044906 2/2006

* cited by examiner

L0: length of sheet

L1: length from upstream roller to downstream roller

L2: length from leading end of sheet to double feed area

L3: length of double feed

Re-feed (re-separation by document separation roller)

Resetting Tc1 when leading end of sheet passes

Resetting Tc2 when leading end of double feed portion passes

Calculating L2 from value of Tc1
L2 = Tc1 x transporting speed

Resetting Tc3 when trailing end of double feed portion passes

Calculating L3 from value of Tc2
L3 = Tc2 x transporting speed

When L3 < L1, waiting until value of Tc1 reaches time for moving distance L4

When L3 < L1, waiting until value of Tc3 reaches time for moving distance L5

SHEET TRANSPORTING DEVICE, AND AUTOMATIC DOCUMENT FEEDER AND IMAGE FORMING APPARATUS PROVIDED WITH THE SAME

CROSS-REFERENCE TO RELATED APPLICATION

This application is related to Japanese application No. 2006-304250 filed on Nov. 9, 2006 whose priority is claimed under 35 USC §119, the disclosure of which is incorporated by reference in its entirety.

BACKGROUND OF THE INVENTION

1. Field of the Invention

The present invention relates to a sheet transporting device, an automatic document feeder provided with the sheet transporting device, and an image forming apparatus provided with the sheet transporting device.

2. Description of the Prior Arts

There has been known a sheet transporting device that feeds and transports a sheet one by one from plural sheets set and stacked at a predetermined position. The sheet transporting device described above is used, for example, in an automatic document feeder mounted to a digital multi-function peripheral or a scanner. Alternatively, the sheet transporting device described above is used at a sheet feeding section for feeding a printing sheet in a digital multi-function peripheral or an image forming apparatus including a printer. The sheet transporting device of this type includes a mechanism for separately feeding sheets one by one in a feeding section. However, a so-called double document feed phenomenon infrequently occurs, in which two or more sheets are fed in an overlapped state (double feed).

If a double feed occurs in an automatic document feeder, original images of a read document are not arranged in a correct order, so that the original images of the read document should be re-read from the start. Otherwise, a user who is not aware of the double feed later recognizes that some of the original images of the document are missing. In the worst case, the original documents are not available at that time.

When a double feed occurs in a sheet feeding section of an image forming apparatus, the double feed is detected as a paper jamming, so that the apparatus is stopped. Otherwise, an image in one page might be printed over plural sheets.

The double feed of sheets hinders the reliable and efficient document reading processing or image forming processing. Therefore, it is desirable to improve a document feeding mechanism to prevent the double feed. However, there are various types of sheets to be fed under different conditions, making it difficult to completely eliminate the double feed.

On the assumption that the occurrence of the double feed are inevitable, there has been proposed a device having a mechanism that is provided with a sensor (double feed sensor) for detecting the double feed of a sheet and separates the double-fed sheet without bothering a user. For example, there has been proposed a device that separates the double-fed sheets according to the difference in speed between a pair of upstream rollers and a pair of downstream rollers, when detecting the double feed (refer to, for example, Japanese Unexamined Patent Application Publication No. 2006-44906). There has also been proposed a device that returns a sheet toward the upstream side of a transporting path and re-feeds the sheet, when detecting the double feed (refer to, for example, Japanese Unexamined Patent Application Publication No. 2003-72988).

As described above, devices for separating double-fed sheets with various techniques have been proposed. However, it is unfavorable that the sheet is damaged due to the application of undue force to the sheet, when the double-fed sheets are separated. When a document is a subject to be transported, in particular, there is no substitute for this document, if the document sheet is damaged. A surface of a printing sheet might be roughened upon separating the sheets, which adversely affects the printing. Therefore, a technique capable of separating the double-fed sheets without giving damages thereto has been demanded.

On the other hand, it is necessary to surely separate the double-fed sheets. As described above, a mechanism for separating sheets one by one is generally provided at a sheet feeding section. However, since the surface of the double-fed sheet is extremely smooth or likely to be charged with static electricity, it is considered that the double-fed sheets are difficult to be separated in most cases. Therefore, a technique for surely separating the double-fed sheets has been demanded.

It is undesirable to take extra time for separating sheets. In particular, an efficient process is strongly desired in a so-called high-speed machine. Therefore, a technique for separating the double-fed sheets without taking extra time as much as possible has been demanded.

SUMMARY OF THE INVENTION

The present invention is accomplished in view of the foregoing circumstance, and aims to provide a sheet transporting device that can surely separate double-fed sheets without giving damages as much as possible. The present invention also provides a sheet transporting device that can separate double-fed sheets without taking extra processing time.

The present invention provides a sheet transporting device including: a sheet feeding section that feeds plural sheets one by one to a transporting path; a pair of upstream transporting rollers and a pair of downstream transporting rollers that are arranged at the upstream side and the downstream side of the transporting path with a predetermined space, and are driven for transporting sheets; a double feed detecting section that detects a length of a double feed portion, which is an overlapped portion, when sheets are fed in such a manner that another sheet is overlapped with a part of one sheet; a determining section that determines whether the length of the double feed portion is shorter than the predetermined space or not; and a transport control section that controls the drives of the pair of the upstream transporting rollers and the pair of the downstream transporting rollers, wherein the transport control section controls the transporting speeds of the pair of the upstream transporting rollers and the pair of the downstream transporting rollers so as to separate the delaying sheet from the preceding sheet of the overlapped sheets, when the double feed portion is positioned between the pair of the upstream transporting rollers and the pair of the downstream transporting rollers in a case where the determining section determines that the length of the double feed portion is shorter than the predetermined space.

Further, the present invention provides an automatic document feeder provided with the sheet transporting device.

Further, the present invention provides an image forming apparatus provided with the sheet transporting device.

DETAILED DESCRIPTION OF THE PREFERRED EMBODIMENTS

Figure 1:
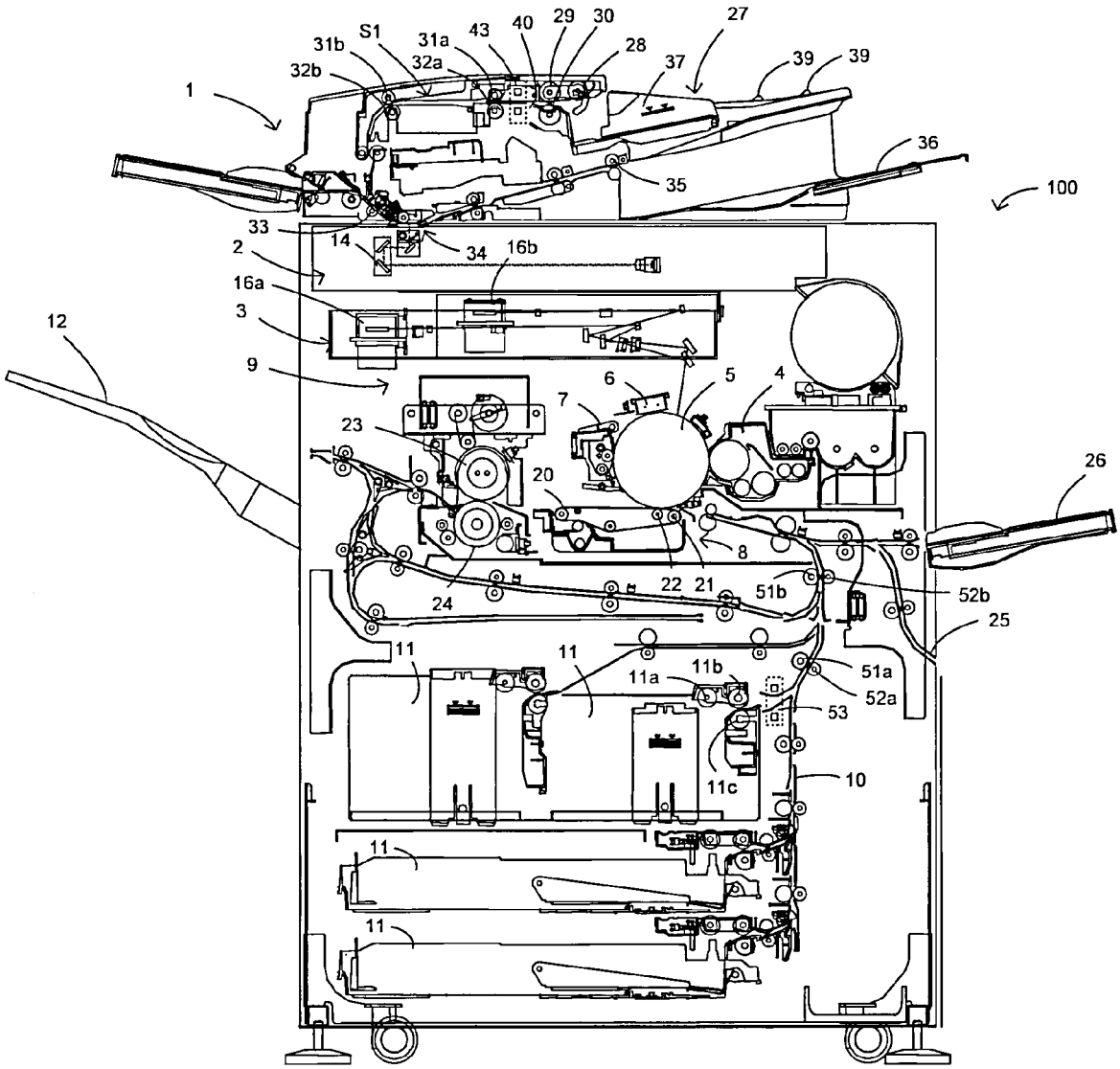
FIG. 1 is a sectional view showing an example of configurations of a digital copier to which a sheet transporting device according to the present invention is applied and an automatic document feeder (ADF) to which the sheet transporting device according to the present invention is applied.

In the sheet transporting device according to the present invention, a transport control section makes the transporting speed of the pair of the upstream document transporting rollers and the transporting speed of the pair of the downstream document transporting rollers different from each other when the double feed portion is positioned between the pair of the upstream document transporting rollers and the pair of the downstream document transporting rollers in order to separate the delaying sheet from the preceding sheet, whereby sheets can be separated without forcibly rubbing the sheet or giving damages to the sheet. Since sheets are separated as each of the pairs of the transporting rollers nip the sheets to be separated one by one, the sheets can more surely be separated. In order to make the transporting speeds of each of the pairs of the transporting rollers different, only the pair of the upstream document transporting rollers may be decelerated or stopped and the pair of the downstream document transporting rollers may keep its transporting speed to transport the preceding sheet, whereby it is unnecessary to decrease the transporting speed of the sheet for the separation. Therefore, the double-fed sheets can be separated without taking extra processing time.

It is when the length of the double feed portion is shorter than the space between the pair of the upstream document transporting rollers and the pair of the downstream document transporting rollers that the double-fed sheets are separated according to the difference in the speed between the pairs of the transporting rollers. However, usually, a mechanism for separating sheets one by one is provided at a sheet feeding section, so that the double feed in which the sheets are perfectly overlapped with each other is infrequent. The separating mechanism is designed such that the double feed in which the sheets are perfectly overlapped with each other is infrequent. The arrangement space of the pairs of the transporting rollers is mostly set to be slightly shorter than the length of a sheet of a minimum size that can be transported. It is considered that the case in which the double feed portion is shorter than the arrangement space frequently occurs. On the other hand, when the length of the double feed portion is longer than the space, the sheets may be separated by a conventional technique. Accordingly, the excellent effect of the present invention can be provided for at least the case in which the double feed portion is shorter than the arrangement space, whereby the separation performance is not inferior to the conventional technique.

The transport control section may further controls the sheet feeding section so as to feed the sheet separated from the preceding sheet after the preceding sheet, and successively feed the next sheet from the sheet feeding section. Specifically, if the feeding timing of the next sheet is delayed by the time corresponding to the increased interval between the double-fed sheets, reading or image formation is executed at the timing when the double-fed sheets and the next sheet can be processed, whereby none of the sheets becomes ineffective.

Further, the transport control section may control to transport the delaying sheet after the preceding sheet at an interval by decelerating or stopping the pair of the upstream transporting rollers. By virtue of this configuration, the sheets can be separated without changing the transporting speed of the preceding sheet of the double-fed sheets. If the delaying sheet is delayed with respect to the preceding sheet at a predetermined interval, and then, transported at a predetermined transporting speed, extra time is not needed to separate the sheets.

Furthermore, the sheet feeding section may include a sheet separating section for separating one sheet from stacked sheets, and the transport control section may decelerate or stop the pair of the transporting rollers after the delaying sheet, which is overlapped with the preceding sheet, passes through the sheet separating section. By virtue of this configuration, the state in which a part of the sheet keeps in contact with the separating section for a long period can be avoided. The separating section may rub the sheet or warp the sheet depending upon its structure. This invention is preferable from this viewpoint.

Further, the sheet transporting device may further include a registration roller that is arranged at the downstream side from the pair of the downstream transporting rollers, and temporarily stops the leading end of a sheet to be transported at a predetermined position and feeds the sheet at a predetermined timing, wherein the transport control section may decelerate or stop the pair of the upstream transporting rollers before the delaying sheet, which is overlapped with the preceding sheet, reaches the registration roller. The registration roller is for sending the sheet in synchronous with a predetermined timing for the reading or image processing. When the pair of the upstream document transporting rollers are decelerated or stopped during the operation for sending the sheet, the operation for sending the sheet becomes unstable. Therefore, it is preferable that the pair of the upstream document transporting rollers are decelerated or stopped at the position before the sheet reaches the registration roller.

The transport control section may control each of the pairs of the transporting rollers so as to return both the preceding sheet and the delaying sheet to the sheet feeding section and further control the sheet feeding section so as to re-feed the returned sheets in a case where the length of the double feed portion is not less than the predetermined space. By virtue of this configuration, the double-fed sheets can be separated even if the length of the double feed portion is not less than the space.

Further, the sheet feeding section may include a sheet separating section for separating one sheet from stacked sheets, and the transport control section may control to return the double feed portion of the preceding sheet and the delaying sheet to the upstream side from the sheet separating section. By virtue of this configuration, the sheets can be separated with the use of the separating section by returning the double feed portion to the upstream side from the sheet separating section and re-feeding the sheet.

Alternatively, the sheet feeding section may include a sheet separating section for separating one sheet from stacked sheets, and the transport control section may control to return the preceding sheet and the delaying sheet to the upstream side from the sheet separating section. By virtue of this configuration, the state in which a part of the sheet comes in contact with the separating section during the period from when the sheet is returned to when the sheet is re-fed can be avoided. The separating section may rub the sheet or warp the sheet depending upon its structure. This invention is preferable from this viewpoint.

Further, the sheet transporting device may further include a size acquiring section for acquiring a size of stacked sheets before the feeding, wherein the double feed detecting section may detect the length from the leading end of the preceding sheet to the leading end of the double feed portion, and the determining section may calculate the difference between the length of the acquired size in the transporting direction and the length from the leading end of the preceding sheet to the leading end of the double feed portion and defines the difference as the length of the double feed portion. By virtue of this configuration, the length of the double feed portion can be obtained at the point when the leading end of the double feed portion passes through the double feed detecting section. As a result, when the sheet is returned to the sheet feeding section and re-fed, the sheet is returned at the point earlier than the point when the trailing end of the double feed portion reaches the double feed detecting section, whereby the sheet can be re-fed in a shorter period.

The present invention will be described in detail with reference to the drawings. It should be understood that the following description is illustrative of the invention in all aspects, but not limitative of the invention.

Example of Configuration of Sheet Transporting Device

FIG. 1 is a sectional view showing an example of configurations of an image forming apparatus to which a sheet transporting device according to the present invention is applied and an automatic document feeder (ADF) to which the sheet transporting device according to the present invention is applied. The image forming apparatus in FIG. 1 is an electrophotographic digital copier.

Overall Configuration And Operation of Copier

In FIG. 1, a sheet fed from a sheet feeding tray 11 of a copier 100 passes through a sheet transporting path 10 to reach a transferring section to which a transfer unit 8 is arranged. The sheet transporting device according to the present invention is applied in the sheet transporting path 10. An image reading section 2 for reading an image of a document is arranged at the upper part of the main body of the copier 100. An ADF 1 is mounted above the image reading section 2. The ADF 1 feeds the document placed onto an original tray 27 so as to transport the same to a reading position of the image reading section 2. The sheet transporting device according to the present invention is applied in the transporting path through which the document reaches the reading position. The copier 100 scans the document (sheet) transported by the ADF 1 to obtain image data, and forms the image according to the obtained image data or image data externally transmitted onto the sheet fed from the sheet feeding section of the sheet feeding tray 11 or the like.

The image forming apparatus 100 is mainly composed of the ADF 1, the image reading section 2, an optical writing unit 3 serving as an image forming section, a developing unit 4, a photoconductor 5, a charging device 6, a cleaner unit 7, a transfer unit 8, a fuser unit 9, the sheet transporting path 10, the sheet feeding tray 11 and a sheet exit tray 12.

The image reading section (reading device) 2 is mainly composed of a light source holder 13, a mirror group 14, and a CCD 15. When the document conveyed from the ADF 1 is scanned, a later-described control section scans the image of the document with the light source holder 13 and the mirror group 14 stood still at a predetermined position (document reading section 34). Light is irradiated to the document from the light source of the light source holder 13 in accordance with the document transported from the ADF 1. Some of the irradiated lights are reflected from the document surface to be focused on the CCD 15 through the mirror group 14. The output signal from the CCD 15 is processed to be converted into digital data, whereby image data according to the image of the document can be obtained. The specific configuration and operation of the ADF 1 will be described later.

The charging device 6 is charging means for uniformly charging the surface of the photoconductor 5 at a predetermined potential. Although the image forming apparatus 100 in the embodiment employs a charger-type charging device 6, a contact-type charging device, such as a roller-type charger or brush-type charger, can be employed.

In the present embodiment, a laser scanning unit (LSU) provided with a laser irradiating sections 16*a* and 16*b* and mirror groups 17*a* and 17*b* is used as the optical writing unit (image forming section) 3. However, instead of this, an EL writing head or an LED writing head having light-emitting devices arranged in an array can be used. The optical writing unit 3 employs a two-beam system provided with two laser irradiating sections 16*a* and 16*b* in order to cope with high-speed printing process. This reduces a load involved with the increased speed in the irradiation timing. The optical writing unit 3 irradiates laser scanning beam, which is modulated in accordance with the inputted image data, from the laser irradiating sections 16*a* and 16*b*. The irradiated laser beam reaches the photoconductor 5 through the mirror groups 17*a* and 17*b*, thereby exposing the uniformly charged photoconductor 5 with a pattern according to the image data. Thus, an electrostatic latent image is formed on the surface of the photoconductor 5.

The developing unit 4 is arranged in the vicinity of the photoconductor 5. The developing unit 4 makes the electrostatic latent image formed on the surface of the photoconductor 5 visible with black toner. The cleaner unit 7 is arranged around the photoconductor 5. The cleaner unit 7 removes and collects residual toners on the surface of the photoconductor 5 after the development and image transfer.

The copier 100 has a control section, not shown, for integrally controlling the overall device. The control section includes a main CPU, ROM, RAM, non-volatile memory, input circuit, driver circuit, output circuit, communication circuit, etc. The ROM stores a control program executed by the main CPU. The RAM provides a work area to the main CPU. The non-volatile memory holds data used for the control. The input circuit is a circuit to which signals from the detecting means at the respective sections of the copier 100 are inputted. The driver circuit drives a load such as an actuator or motor for operating each of the driving mechanisms in the copier 100. The output circuit outputs a control signal to the subject to be controlled such as the laser irradiation sections 16*a* and 16*b*. The communication circuit makes communication with a later-described ADF control section of the ADF 1. The main CPU can execute processing with the use of the signals inputted to the input circuit. Further, the main CPU can drive each load through the driver circuit. The main CPU can further output a control signal to the subject to be controlled through the output circuit. The main CPU can also receive or send information or commands, necessary for the control, from or to the ADF control section of the ADF 1 through the communication circuit.

The electrostatic image that is made visible on the surface of the photoconductor 5 as described above is transferred onto a recording sheet by applying an electric field, which is reverse in polarity to the charges of the electrostatic image, to the transported recording sheet from the transfer unit 8. For example, when the electrostatic image has charges of a negative polarity, the applying polarity of the transfer unit 8 is positive. A transfer belt 19 of the transfer unit 8 is stretched by a drive roller 20, driven roller 21 and other rollers, and has a predetermined resistance value (e.g., within the range of $1\times10^{9}$ to $1\times10^{13}$ Ω·cm). An elastic conductive roller 22 having conductivity and capable of applying transfer electric field is arranged at the contact portion of the photoconductor 5 and the transfer belt 19.

The electrostatic image (non-fixed toner) transferred onto the recording sheet at the transfer unit 8 is transported to the fuser unit 9. The fuser unit 9 fuses the non-fixed toner to be fixed onto the recording sheet. The fuser unit 9 has a heat roller 23 and a pressure roller 24. A heat source for heating the surface of the heat roller 23 to a predetermined temperature (fusing temperature: about 160 to 200° C.) is arranged at the inner peripheral portion of the heat roller 23. On the other hand, unillustrated pressure members are arranged at both ends of the pressure roller 24 such that the pressure roller 24 comes in pressed contact with the heat roller 23 with a predetermined pressure. Accordingly, the non-fixed toner on the transported recording sheet is heated by the heat roller 23 to be fused at the press-contact portion (referred to as fusing nip portion) between the heat roller 23 and the pressure roller 24. The fused toner is pressed against the recording sheet to remain fixed on its surface.

Plural sheet feeding trays 11 are for accumulating recording sheets used for the image formation. Each of the sheet feeding trays 11 corresponds to a sheet feeding section in the aspects. In the copier 100 in the embodiment, the sheet feeding trays 11 are mounted at the lower part of the main body. The copier 100 in the embodiment is a so-called high-speed machine. Therefore, each of the sheet feeding trays 11 is designed so as to be capable of storing a great number of sheets. Each of the sheet feeding trays 11 can store 500 to 1500 recording sheets of a standard size. Arranged at the sheet feeding tray 11 are a pickup roller 11*a*, sheet feeding roller 11*b* and separation roller 11*c*. The pickup roller 11*a* sends a sheet one by one from a stack of sheets placed onto the sheet feeding tray 11 to the sheet transporting path 10. A pair of the sheet feeding roller 11*b* and the separation roller 11*c* transports the sheet to the downstream side of the sheet transporting path 10 while separating the sheet sent to the sheet transporting path 10 by the pickup roller 11*a*. The pair of the sheet feeding roller 11*b* and the separation roller 11*c* is a separating section described in the aspects.

A double feed sensor (double feed detecting section) for detecting the double feed of the fed sheet, plural pairs of transporting roller 51 and driven roller 52 (different alphabets are appended at the end of the numeral of each pair) are arranged at the sheet transporting path 10 through which the sheet fed from the sheet feeding tray 11 passes. Plural pairs of the transporting roller 51 and the driven roller 52 are provided along the sheet transporting path 10 for transporting the sheet sent to the sheet transporting path 10 to the transfer section. A registration roller 18 stops the sheet passing through the sheet transporting path 10 at a predetermined position by bringing the leading end of the sheet in contact thereto, and then, transports the sheet to the transfer section at a predetermined timing.

A double feed sensor 53 is provided between the pair of the sheet feeding roller 11*b* and the separation roller 11*c* and the pair of the transporting roller 51 and the driven roller 52. The double feed sensor 53 is composed of a transmitter 53*a* that transmits ultrasonic wave, and a receiver 53*b* that receives the ultrasonic wave transmitted from the transmitter 53*a* through the sheet transporting path 10. The degree of the attenuation of the ultrasonic wave from the transmitter 53*a* to the receiver 53*b* varies according to the presence or absence of the sheet passing through the double feed detecting section and the presence or absence of the double feed of the passing sheet. By using this property, the presence or absence of the double feed of the document passing through the double feed sensor 53 and the passing time of the double feed portion are detected. The length of the double feed portion in the transporting direction is obtained from the detected passing time of the double feed portion and the predetermined document transporting speed.

A transporting path 25 to which a large-capacity cassette capable of storing a greater number of sheets is attached and a manual sheet feeding tray 26 for feeding mainly a sheet of a non-standard size are mounted to the side face of the main body of the copier 100.

The sheet exit tray 12 is arranged at the side face of the main body opposite to the manual sheet feeding tray 26. The copier 100 has a configuration in which a finisher for performing a post-processing of the discharged sheet (stapling, punching, etc.) or a multi-bin sheet exit tray can be arranged as an option instead of the sheet exit tray 12.

Configuration And Operation of ADF

Figure 2A:
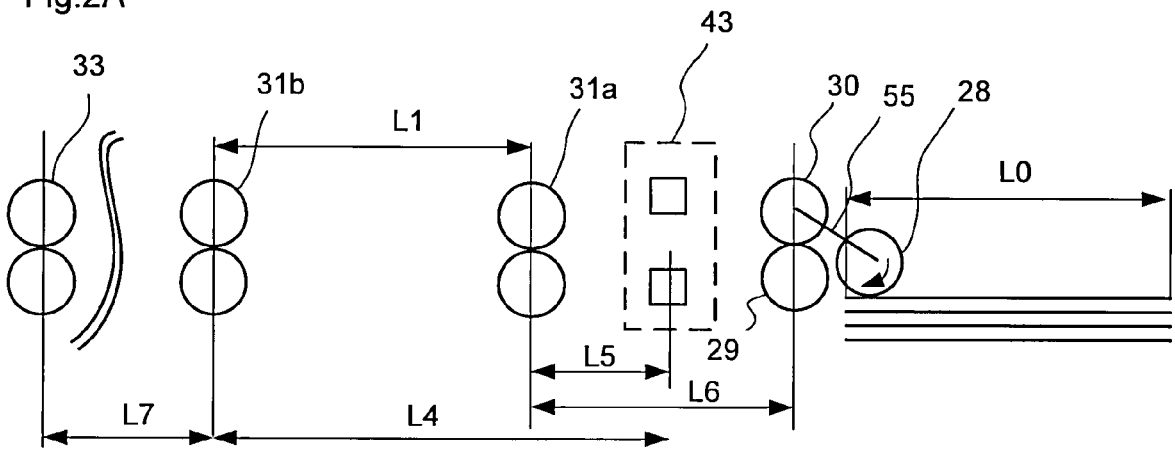
FIGS. 2A and 2B are schematic views showing a schematic configuration of an ADF (automatic document feeder) according to the sheet transporting device of the present invention.
Figure 2B:
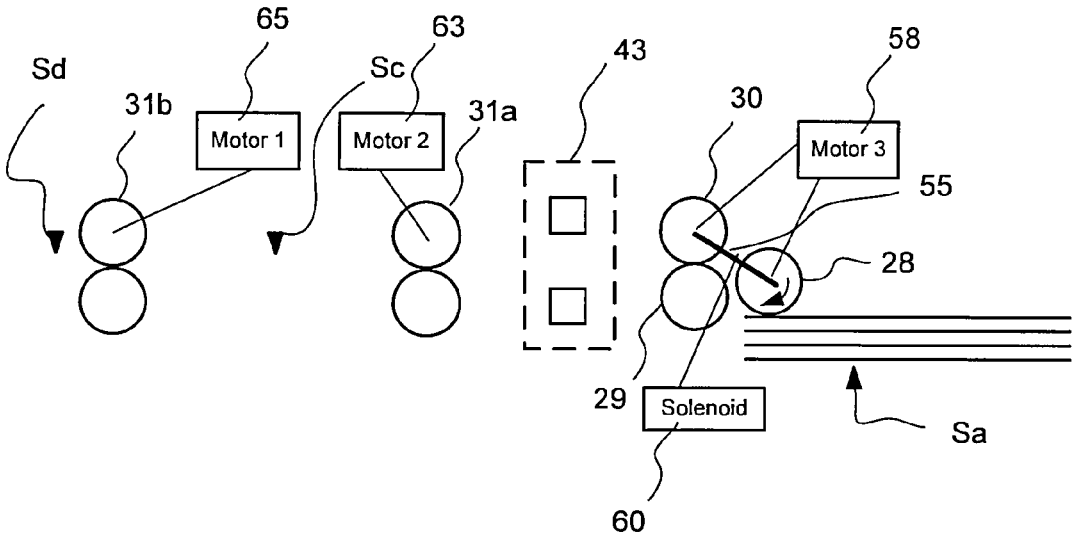

The ADF 1 mounted to the aforesaid copier 100 will be explained with reference to FIGS. 2A and 2B. FIGS. 2A and 2B are schematic views showing the configuration of the ADF (document automatic feeder) according to the sheet transporting device of the present invention.

More specifically, as shown in FIGS. 2A and 2B, the ADF 1 is mainly composed of a document tray 27 serving as a sheet feeding section, document pickup roller 28, document feeding roller 29, document separation roller 30, plural pairs of a document transporting roller 31 and a driven roller 32 (different alphabets are appended at the end of the numeral of each pair), document registration roller 33, document exit roller 35, and document exit tray 36. The ADF 1 further includes a document length sensor (sheet length detecting section) 39, transport length sensor (transport length detecting section) 40 and document double feed sensor 43 (document double feed detecting section).

The ADF 1 also has an ADF control section not shown. The ADF control section is composed of a sub-CPU, ROM, RAM, non-volatile memory, input circuit, driver circuit, output circuit, communication circuit, etc. The ROM stores a control program executed by the sub-CPU. The RAM provides a work area to the sub-CPU. The non-volatile memory holds data used for the control. The input circuit is a circuit to which signals from the detecting means for each section of the ADF 1 are inputted. The driver circuit drives a load such as an actuator or motor for operating the driving mechanism for each section of the ADF 1. The output circuit outputs control signals to the subject to be controlled such as the transmitter 43*a* of the document double feed sensor 43. The communication circuit makes a communication with the control section of the main body of the copier 100. The sub-CPU can execute processing with the use of the signals inputted to the input circuit. The sub-CPU can also drive each load through the driver circuit. The sub-CPU can also output control signals to the subject to be controlled through the output circuit.

The document tray 27 is a tray for a user to place a document stack thereon. The document pickup roller 28 sends the document one by one to the document transporting path S1 from the document stack placed onto the document tray 27. The pair of the document feeding roller 29 and the document separation roller 30 transports the document to the downstream side of the document transporting path S1 while separating the document sent to the document transporting path S1 by the document pickup roller 28. The pair of the document feeding roller 29 and the document separation roller 30 is a separating section described in the aspects. Plural pairs of the document transporting roller 31 and the driven roller 32 are provided along the document transporting path S1 for transporting the document sent to the document transporting path S1 to the document reading section 34. The document registration roller 33 stops the document passing through the document transporting path S1 at a predetermined position by bringing the leading end of the document into contact thereto, and then, transports the document to the document reading section 34 at a predetermined timing. The document exit roller 35 exits the document, which has been subject to the image-reading at the image reading section 34, to the document exit tray 36.

The document length sensor (sheet length detecting section) 39 detects the length of the document placed onto the document tray 27 in the transporting direction. The transport length sensor 40 detects the length of the transported document for every one document. The document double feed sensor 43 detects the double feed when the document is transported as overlapped, and detects the length of the double feed portion in the transporting direction.

A pair of movable regulation plates 37 and plural document length sensors 39 are provided at the document tray 27. A pair of movable regulation plates 37 is used by a user in such a manner that the user moves a pair of movable regulation plates 37 to the position according to the width of the document so as to align the width of the placed document stack in the main scanning direction (the direction orthogonal to the transporting direction). The regulation plates 37 function as a sensor of a document size in the widthwise direction since the position thereof is matched to the width of the document. The document length sensor 39 is composed of plural sensors, each of which is arranged along the transporting direction of the document. Each sensor has a movable cantilever section, wherein a part of the cantilever section protrudes over the document tray 27 with the document not placed. When the document is placed onto the document tray 27, the leading end of the cantilever section at the area covered by the document is lowered below the surface of the tray. Each sensor changes the signal in response to the displacement of the cantilever. The length of the document in the transporting direction is detected from the combination of the signals of the document length sensors 39 provided at each portion. The ADF control section specifies one standard size, among plural standard sizes, in accordance with the result of the detection of the document width by the regulation plates 37 and the result of the detection of the document length by the document length sensors 39, so as to obtain the size of the document on the document tray 27.

The transport length sensor 40 provided with a cantilever that displaces due to the contact to the fed document is disposed between the document pickup roller 28 and the document separation roller 30. The cantilever of the transport length sensor 40 rises when the leading end of the document passes, while it returns to the original position when the trailing end of the document passes. Therefore, the document passing time taken from when the cantilever rises to when it returns to the original position is counted, wherein the length of each of the fed documents in the transporting direction is obtained from the counted passing time and the predetermined document transporting speed. Thus, the length of each document can be obtained even if documents each having a different size in the transporting direction are mixedly placed.

The document double feed sensor 43 is mounted between the pair of the document feeding roller 29 and the document separation roller 30 and the pair of the document transporting roller 31 and the driven roller 32. The document double feed sensor 43 is composed of a transmitter 43*a* that transmits ultrasonic wave, and a receiver 43*b* that receives the ultrasonic wave transmitted from the transmitter 43*a* through the document transporting path S1. The degree of the attenuation of the ultrasonic wave from the transmitter 43*a* to the receiver 43*b* varies according to the presence or absence of the document passing through the double feed detecting section and the presence or absence of the double feed of the passing document. By using this property, the presence or absence of the double feed of the document passing through the double feed sensor 43 and the passing time of the double feed portion are detected. The length of the double feed portion in the transporting direction is obtained from the detected passing time of the double feed portion and the predetermined document transporting speed.

Detection of Double Feed And Separation of Sheet

The operation of the sheet separating device according to the present invention will be described in detail. In the following description, the sheet separating device of the ADF 1 is taken as an example. However, the sheet separating device at the main body of the image forming apparatus 100 also has the similar structure. A person skilled in the art would easily apply this description to the sheet separating device at the main body of the image forming apparatus 100.

FIGS. 2A and 2B are explanatory views schematically showing the components arranged in the transporting path from the document tray 27 to the document registration roller 33, and their arrangement relationship. FIG. 2A shows the arrangement of the rollers and document double feed sensor 43 in the transporting path. In FIG. 2A, a document having a length L0 in the transporting direction is placed onto the document tray 27 at the right end. The document is transported from the right side to the left side in FIG. 2A. Arranged in the document transporting path are the document pickup roller 28, the pair of the document transporting roller 29 and the document separation roller 30, the document double feed sensor 43, the pair of the document transporting roller 31*a* and the driven roller 32*a*, the pair of the document transporting roller 31*b* and the driven roller 32*b*, and the document registration roller 33, in this order from the upstream side of the transporting path. Among these, the components mainly constituting the characteristic portion of the sheet separating device of the present invention are the document double feed sensor 43, the pair of the document transporting roller 31*a* and the driven roller 32*a*, and the pair of the document transporting roller 31*b* and the driven roller 32*b*. The distance from the document feeding roller 29 to the document transporting roller 31*a* (upstream document transporting roller) at its downstream side is L6. The distance from the document double feed sensor 43 arranged at the downstream side of the document feeding roller 29 to the document transporting roller 3*a* at its downstream side is L5. The distance from the document transporting roller 31*a* to the document transporting roller 31*b* (downstream document transporting roller) at its downstream side is L1. The distance from the document double feed sensor 43 to the document transporting roller 31*b* at its downstream side is L4. The distance from the document transporting roller 31*b* to the document registration roller 33 at its downstream side is L7.

FIG. 2B schematically shows the arrangement of driving sources for driving each roller in FIG. 2A. The document transporting roller 31*b* is driven by a first drive motor (motor 1) 65. The document transporting roller 31*a* is driven by a second drive motor (motor 2) 63. The document feeding roller 29, document pickup roller 28 and document separation roller 30 are driven by a third drive motor (motor 3) 58. The document pickup roller 28 is mounted to the leading end of a pickup arm 55 biased upwardly by a spring. This biasing causes the document pickup roller 28 apart from the document other than the feeding. When the ADF control section drives a pickup solenoid 60 upon feeding the document, the pickup arm 55 descends against the biasing force, whereby the document pickup roller 28 comes in contact with the uppermost sheet. The document pickup roller 28 rotates by the drive of the third drive motor 58 so as to send the uppermost sheet to the document feeding roller 29. The fed document is further transported to the downstream side by the document feeding roller 29, while the document separation roller 30 rotates with low speed in the direction of returning the document to the document tray 27. Therefore, the sheet, which is immediately below the uppermost sheet and is fed together with the uppermost sheet, is separated from the uppermost sheet. The separated sheet is fed as the uppermost sheet at the next feeding timing. A document sensor Sa for detecting the presence or absence of the document on the document tray 27, and sheet passage sensors Sc and Sd for detecting the passage of the leading end and trailing end of the sheet are arranged in the document transporting path.

Figure 7:
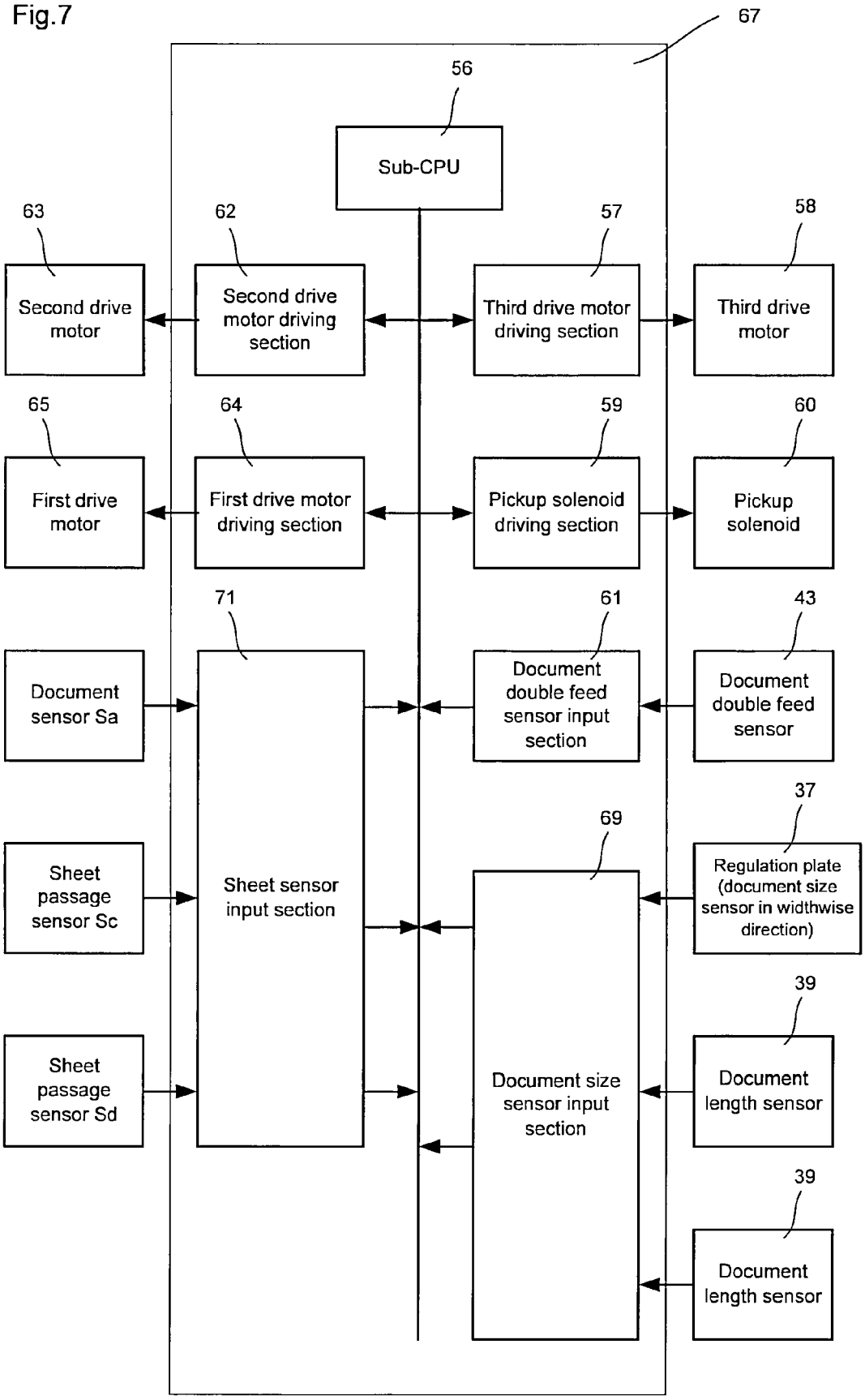
FIG. 7 is a block diagram showing a part of functional configuration of an ADF control section according to the present invention.

FIG. 7 is a block diagram showing a part of the functional configurations of the ADF control section that recognizes the detection signal of the document double feed sensor 43 for driving the motors and solenoids described above. In FIG. 7, the ADF control section 67 includes a sub-CPU 56, first drive motor driving section 64, second drive motor driving section 62, third drive motor driving section 57, pickup solenoid driving section 59, document double feed sensor input section 61, document size sensor input section 69, and sheet sensor input section 71. The first drive motor driving section 64 is a driver circuit for driving the first drive motor 65. The second drive motor driving section 62 is a driver circuit for driving the second drive motor 63. The third drive motor driving section 57 is a driver circuit for driving the third drive motor 58. The pickup solenoid driving section 59 is a driver circuit for driving the pickup solenoid 60. The document double feed sensor input section 61 is an input circuit to which the detection signal from the document double feed sensor 43 is inputted. The document size sensor input section 69 is an input circuit to which signals from the regulation plate 37 for detecting the width of the document and the document length sensor 39 for detecting the length of the document are inputted. The sheet sensor input section 71 is an input circuit to which signals from the document sensor Sa and sheet passing sensors Sc and Sd are inputted.

Figure 3A:
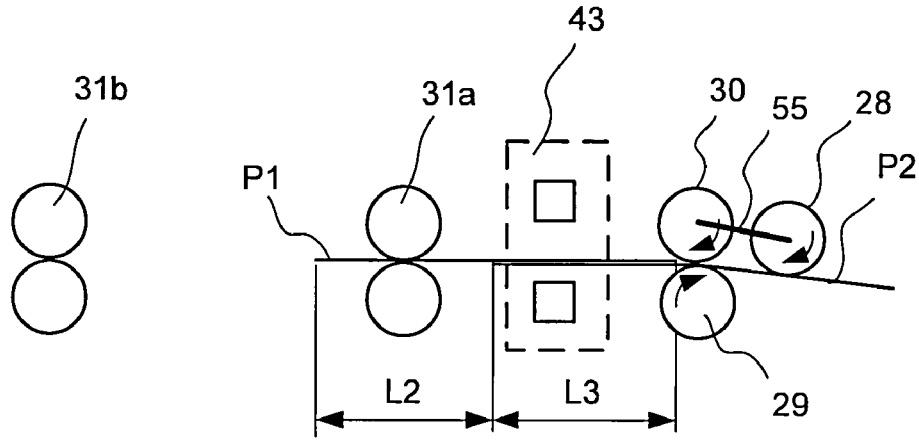
FIGS. 3A to 3C are explanatory views showing a procedure that the sheet separating device according to the present invention separates double-fed sheets, when two sheets are double-fed.
Figure 3B:
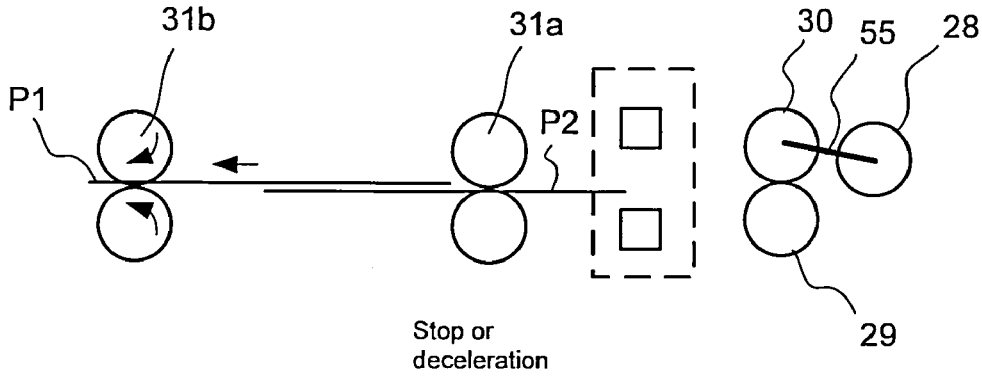
Figure 3C:
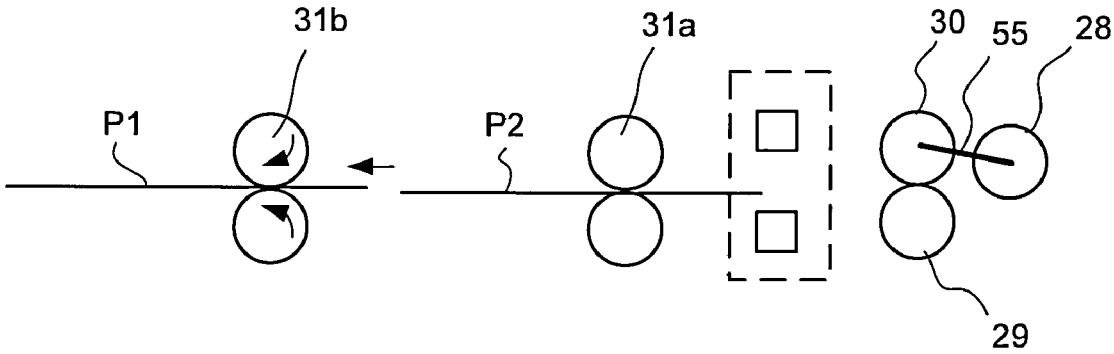

As described above, the document separation roller 30 separates the sheet, which is fed together with the uppermost sheet, from the uppermost sheet by the friction force between the sheet and the surface of the document separation roller. However, when the attraction force between the sheets exceeds the friction force, the overlapped sheets cannot be separated, which causes double feed. FIGS. 3A to 3C are explanatory views showing the procedure for separating the double-fed sheet by the sheet separating device according to the present invention, when two sheets are fed as overlapped. FIG. 3A shows the state in which the double feed portion of two overlapped sheets passes through the document double feed sensor 43. The uppermost sheet P1 of the overlapped sheets is a sheet that should originally be fed. The lowermost sheet P2 is a sheet that is fed together with the uppermost sheet. The sheet P2 is fed in such a manner that the leading end thereof is delayed from the uppermost sheet by the length L2 due to the separating operation of the document separation roller 30. The length of the double feed portion is L3.

The output level of the output signal from the document double feed sensor 43 changes at the respective timings of the timing when the leading end of the sheet P1 passes through the document double feed sensor 43, the timing when leading end of the double feed portion passes through the document double feed sensor 43, the timing when the trailing end of the double feed portion passes through the document double feed sensor 43, and the timing when the trailing end of the sheet P2 passes through the document double feed sensor 43. The ADF control section 67 recognizes each timing on the basis of the change in the level. When the ADF control section 67 recognizes that the trailing end of the double feed portion passes through the document double feed sensor 43, it calculates the length L3 of the double feed portion from the passing time of the leading end and the trailing end of the double feed portion and the sheet transporting speed. Then, the ADF control section 67 compares the calculated length L3 and the distance L1 between the upstream document transporting roller 31*a* and the downstream document transporting roller 31*b*. When L3<L1 as shown in FIG. 3B, the ADF control section 67 waits until the double feed portion is positioned between the upstream document transporting roller 31*a* and the downstream document transporting roller 31*b*, the sheet P1 is nipped between the downstream document transporting roller 31*b* and the driven roller 32*b*, and the sheet P2 is nipped between the upstream document transporting roller 31*a* and the driven roller 32*a*. This timing is specified as the timing when the trailing end of the double feed portion is transported by the distance L5 after the trailing end of the double feed portion is detected, for example. A margin in which the trailing end of the double feed portion completely passes through the upstream document transporting roller 31*a* may be included in the timing.

When it comes to this timing, the ADF control section 67 controls to decrease the transporting speed of the upstream document transporting roller 31*a* from a predetermined document transporting speed or to stop the upstream document transporting roller 31*a*. Thus, the sheet P2 is decelerated or stopped. More specifically, the ADF control section 67 may decrease the speed of the upstream document transporting roller 31*a* to a predetermined speed, or may stop the upstream document transporting roller 31*a* after the deceleration. Alternatively, the ADF control section 67 may stop the upstream document transporting roller 31*a* at the instant. On the other hand, the sheet P1 keeps the predetermined transporting speed to be transported to the downstream side. FIG. 3C shows the state in which the sheet P2 is stopped at the timing shown in FIG. 3B, so that the sheet P2 is separated from the sheet P1.

Figure 4A:
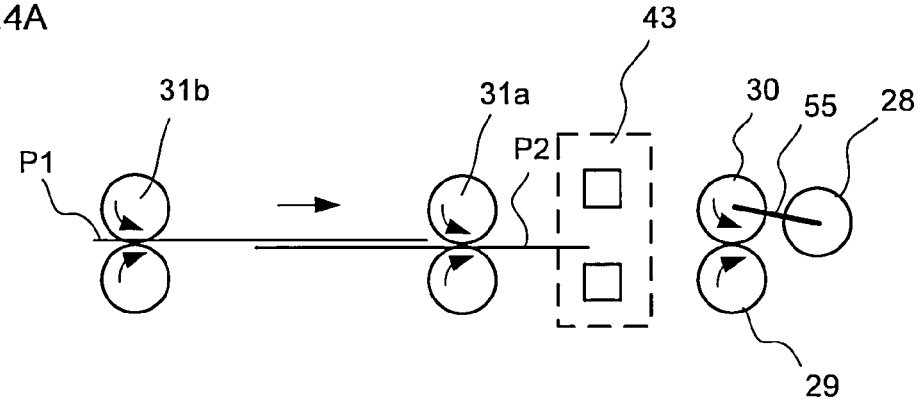
FIGS. 4A and 4B are explanatory views showing the process when a length L3 of a double feed portion is not less than the space between an upstream document transporting roller and a downstream document transporting roller in the sheet separating device according to the present invention.
Figure 4B:
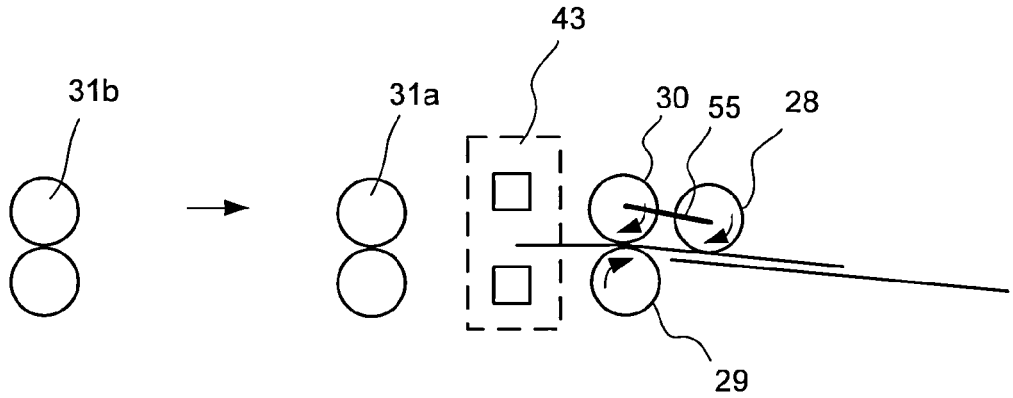

The process in a case where the length of the double feed portion is equal to the distance between the upstream document transporting roller 31*a* and the downstream document transporting roller 31*b* or longer than this distance, i.e., the process in a case where the aforesaid result of the comparison is L3≧L1 will be explained. FIGS. 4A and 4B are explanatory views showing the process when the result of the comparison is L3≧L1. When the ADF control section 67 determines L3≧L1 in a case where the trailing end of the double feed portion passes through the document double feed sensor 43, the ADF control section 67 reverses the upstream document transporting roller 31*a*, downstream document transporting roller 31*b* and document feeding roller 29 at a predetermined speed (see FIG. 4A). With this operation, the sheet is returned to the document tray 27. It is preferable that the driving section of the document separation roller 30 has a one-way clutch. By virtue of this configuration, the document separation roller 30 follows the rotation of the document feeding roller 29 upon the reverse. The ADF control section 67 waits the timing when the double feed portion goes through the document feeding roller 29 to be returned to the document tray 27. This timing is specified as the timing when the trailing end of the double feed portion passes through the document double feed sensor 43 and then returns by the distance (L6−L5). A margin that the trailing end of the double feed portion completely goes through the document feeding roller 29 may further be added to this timing. When it comes to this timing, the ADF control section 67 changes the rotation of the document feeding roller 29 into a normal rotation so as to re-feed the sheet P1 (see FIG. 4B). The sheet P2 receives again the separation operation by the document separation roller 30 upon the re-feeding.

A timer used for the ADF control section 67 to obtain each timing for the control in the aforesaid sheet separating operation will be explained. FIGS. 5A to 5C, 6A and 6B are explanatory views for explaining the function of the timer. In this embodiment, the ADF control section 67 has three timers Tc1, Tc2, and Tc3. The timer Tc1 is a timer with the leading end of the sheet P1 as a reference. The timer Tc2 is a timer with the leading end of the double feed portion as a reference. The timer Tc3 is a timer with the trailing end of the double feed portion as a reference.

Figure 5A:
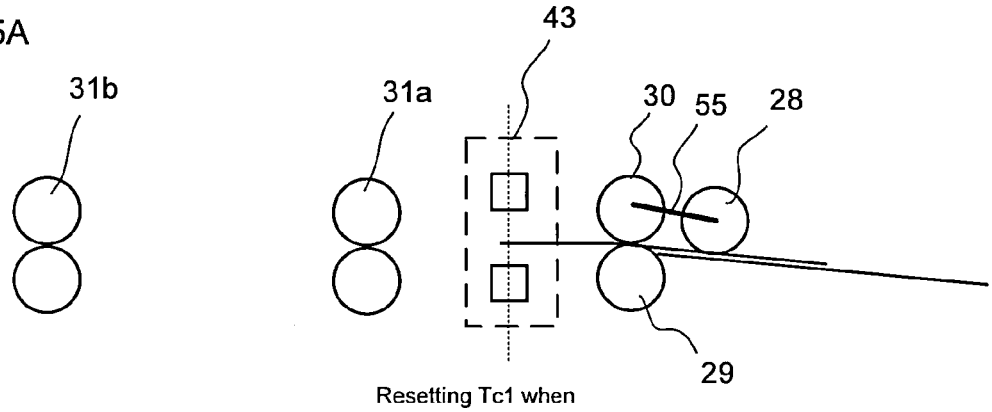
FIGS. 5A to 5C are first explanatory views for explaining a function of a timer used in the sheet separating device according to the present invention.
Figure 5B:
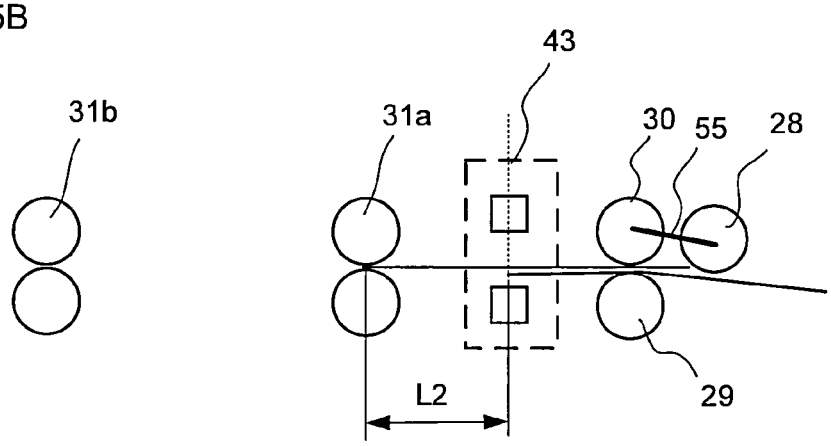
Figure 5C:
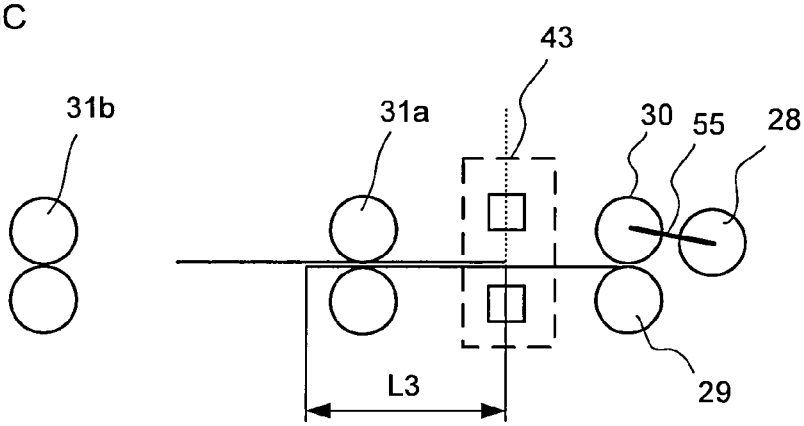

Specifically, when the document double feed sensor 43 detects a leading end of a new sheet from the state where there is no sheet, the ADF control section 67 resets the timer Tc1. FIG. 5A shows the state in which the timer Tc1 is reset. Thereafter, the timer Tc1 keeps running until it detects the leading end of the next sheet. When the document double feed sensor 43 detects the passage of the leading end of the double feed portion, the ADF control section 67 resets the timer Tc2. FIG. 5B shows the state in which the timer Tc2 is reset. The ADF control section 67 samples the timer Tc1 at this time so as to calculate the length L2 up to the double feed portion. Then, the timer Tc2 keeps running, and when it reaches the greatest value, it stops. When the leading end of the next double feed portion is detected, it is reset again. When the document double feed sensor 43 detects the passage of the trailing end of the double feed portion, the ADF control section 67 resets the timer Tc3. FIG. 5C shows the state in which the timer Tc3 is reset. The ADF control section 67 samples the timer Tc2 at this time so as to calculate the length L3 of the double feed portion. Thereafter, the timer Tc3 keeps running, and when it reaches the greatest value, it stops. When the trailing end of the next double feed portion is detected, it is reset again.

Figure 6A:
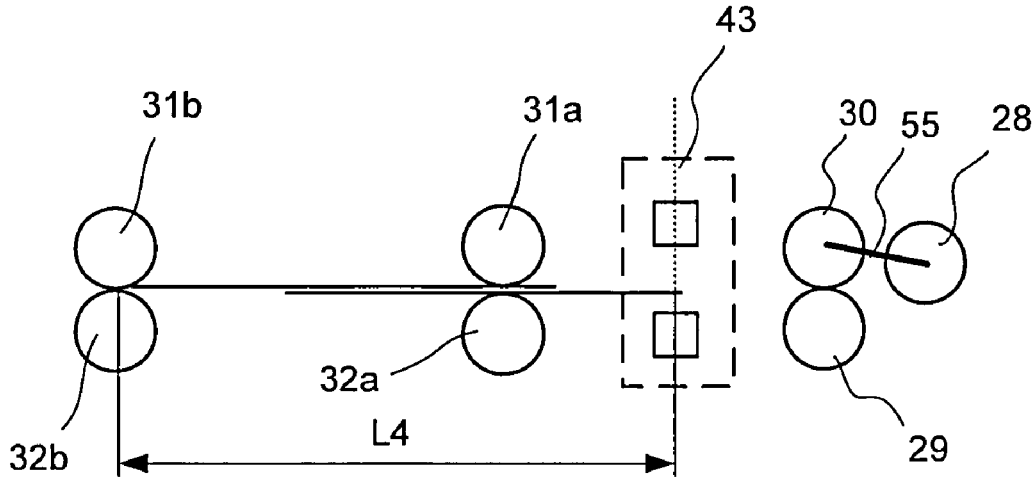
FIGS. 6A and 6B are second explanatory views for explaining a function of a timer used in the sheet separating device according to the present invention.
Figure 6B:
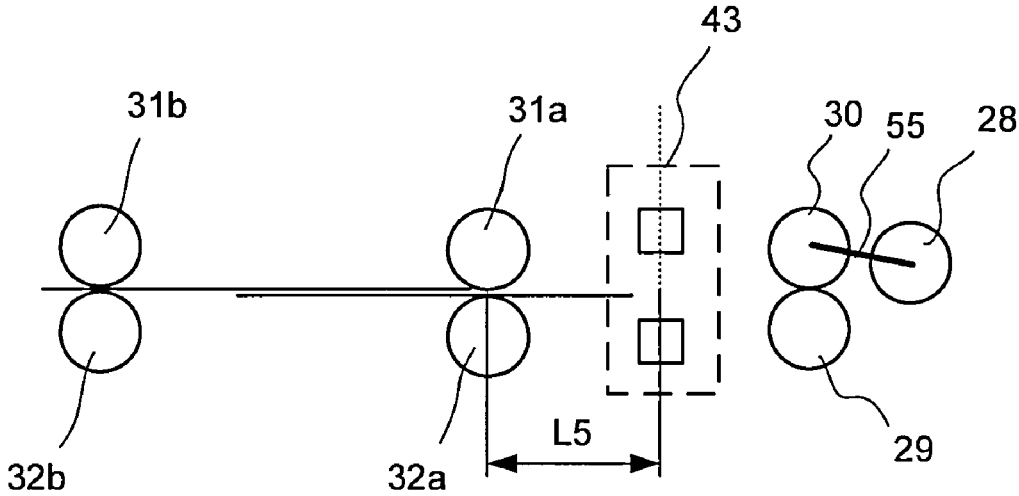

When the ADF control section 67 determines that the length L3 of the double feed portion is shorter than the distance L1 between the upstream document transporting roller 31*a* and the downstream document transporting roller 31*b*, it monitors the timer Tc1 and waits until the time corresponding to the length L4 elapses. FIG. 6A shows this state. As shown in FIG. 6A, the leading end of the sheet P1 reaches the downstream document transporting roller 31*b*. The sheet P1 is nipped between the downstream document transporting roller 31*b* and the driven roller 32*b*. At the same time, the ADF control section 67 monitors the timer Tc3 and waits until the time corresponding to the length L5 elapses. FIG. 6B shows this state. As shown in FIG. 6B, the trailing end of the double feed portion reaches the upstream document transporting roller 31*a*. Only the sheet P2 is nipped between the upstream document transporting roller 31*a* and the driven roller 32*a*. When both conditions are satisfied, the transporting speed of the upstream document transporting roller 31*a* is controlled to be reduced from the predetermined document transporting speed, or the upstream document transporting roller 31*a* is controlled to be stopped. Accordingly, the difference is produced between the transporting speed of the sheet P1 and the transporting speed of the sheet P2.

Procedure of Sheet Separating Process

Figure 8:
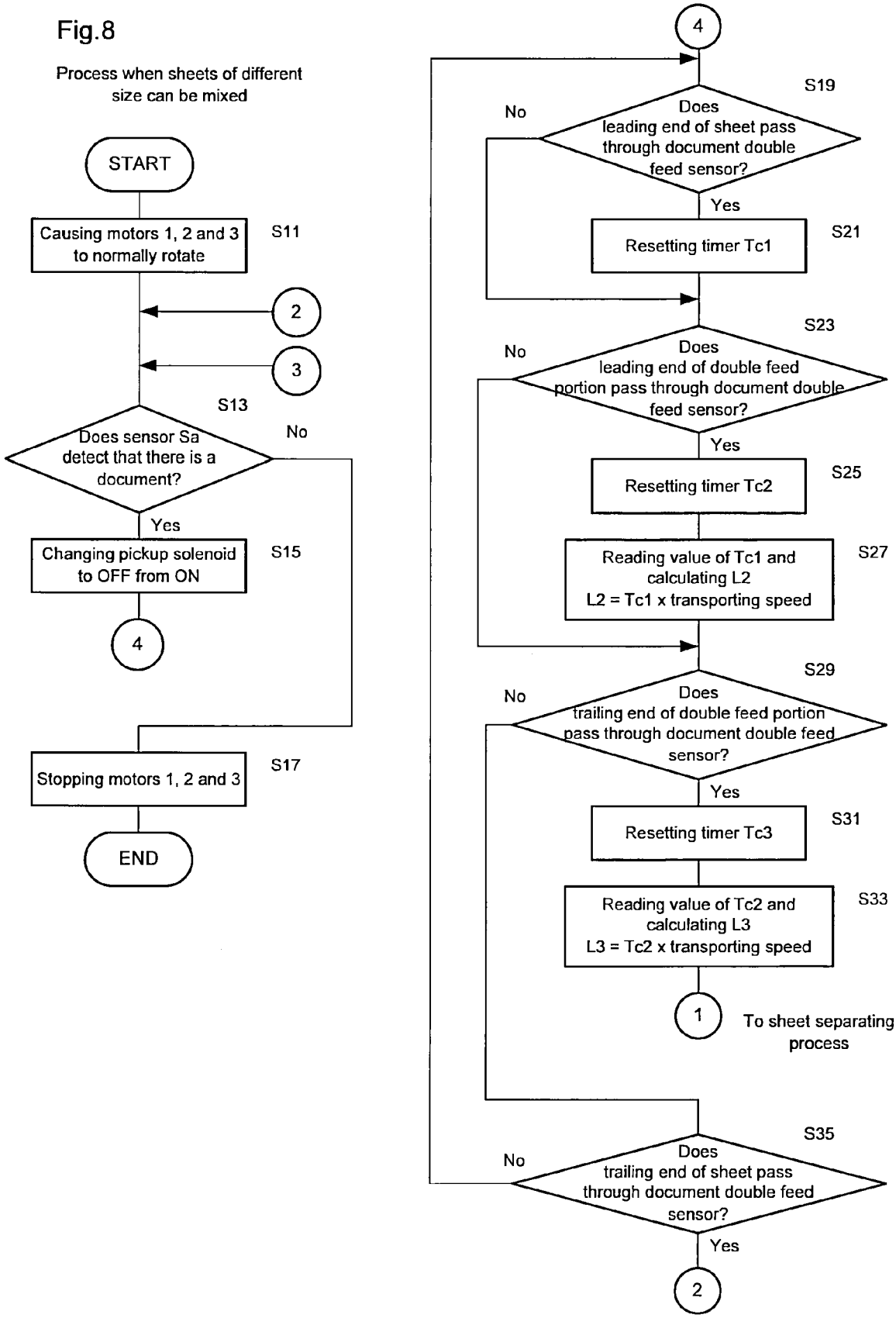
FIG. 8 is a first flowchart showing a procedure of a sheet separating process according to the present invention.
Figure 9:
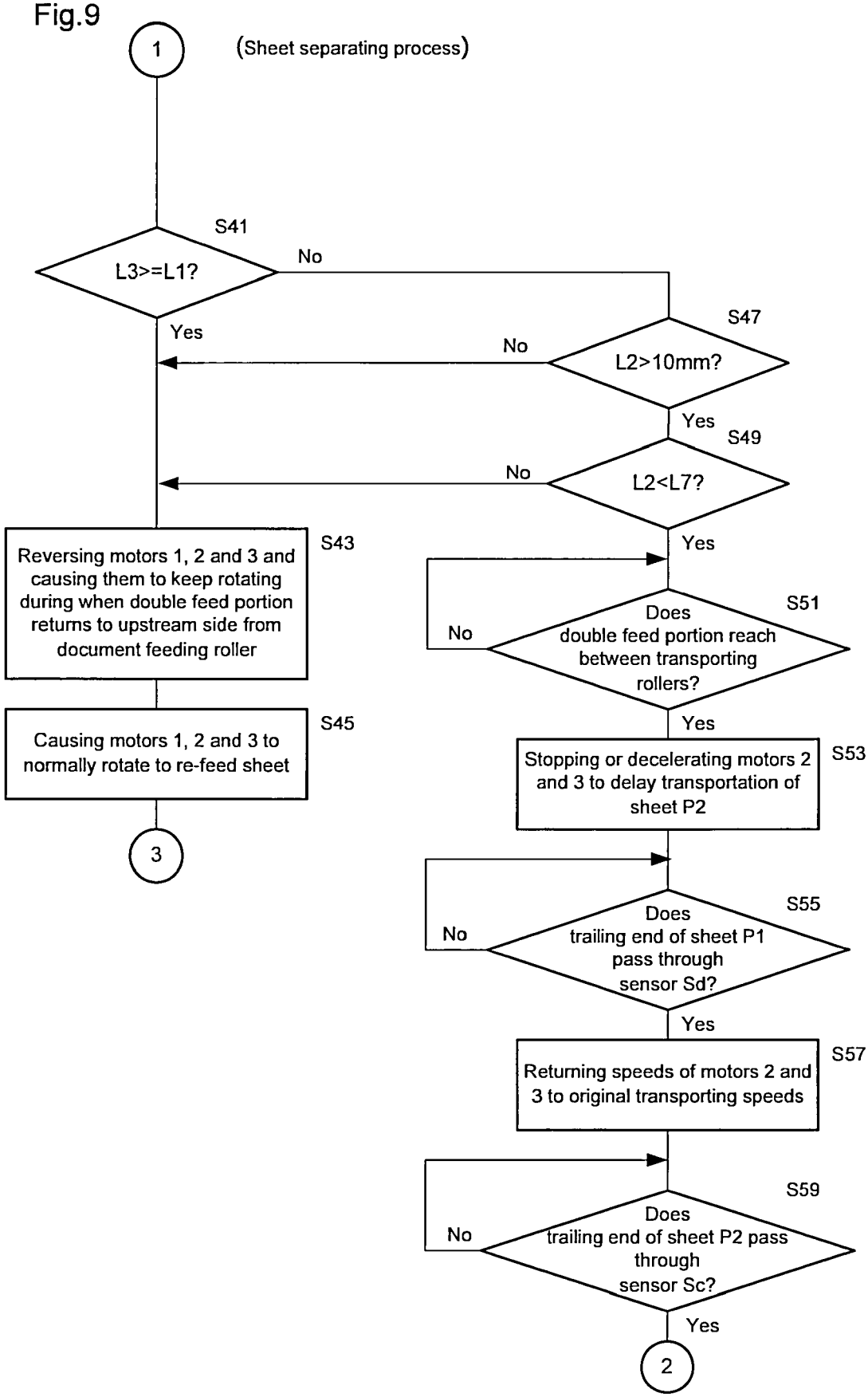
FIG. 9 is a second flowchart showing the procedure of the sheet separating process according to the present invention.
Figure 10:
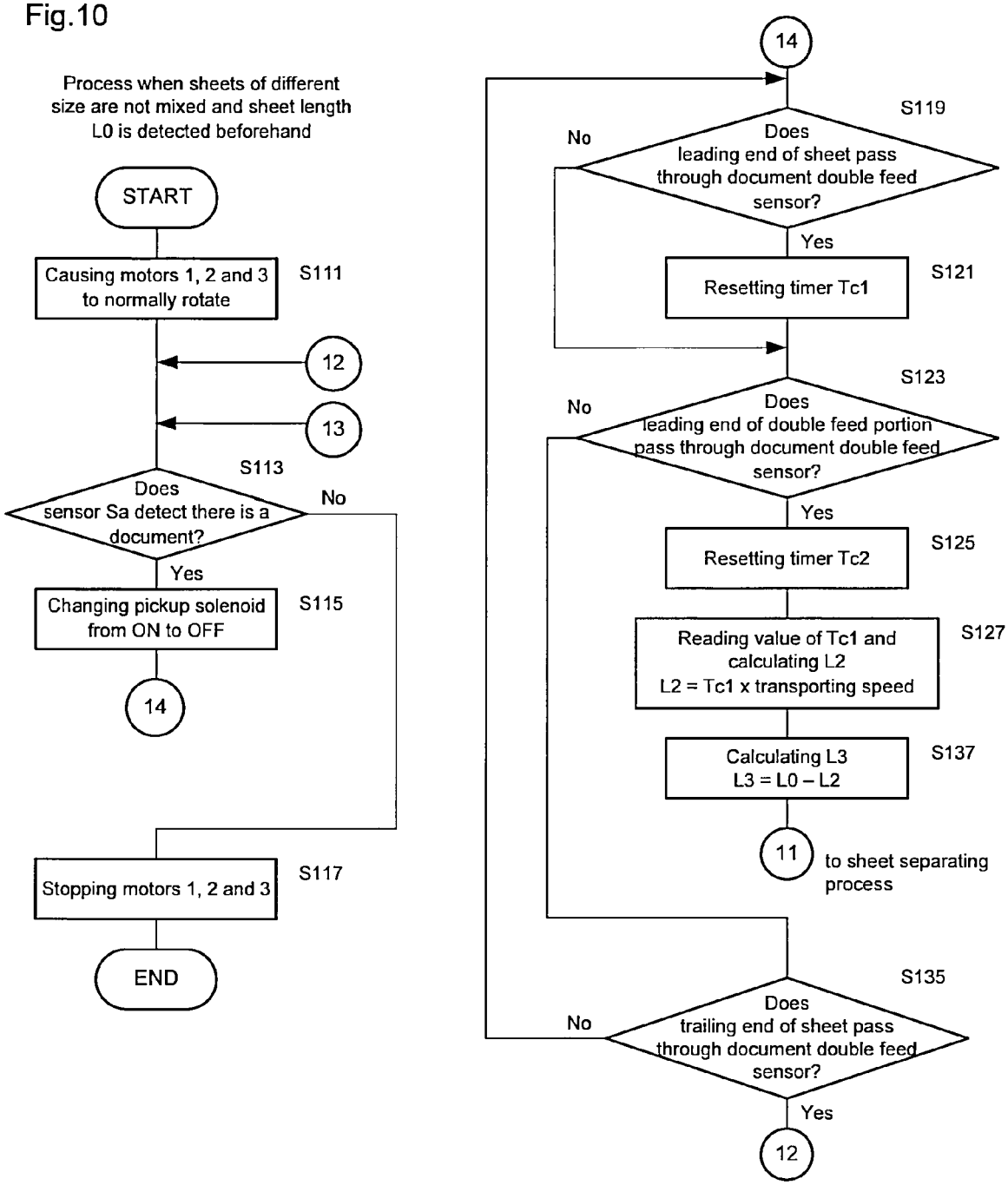
FIG. 10 is a third flowchart showing the procedure of the sheet separating process according to the present invention.
Figure 11:
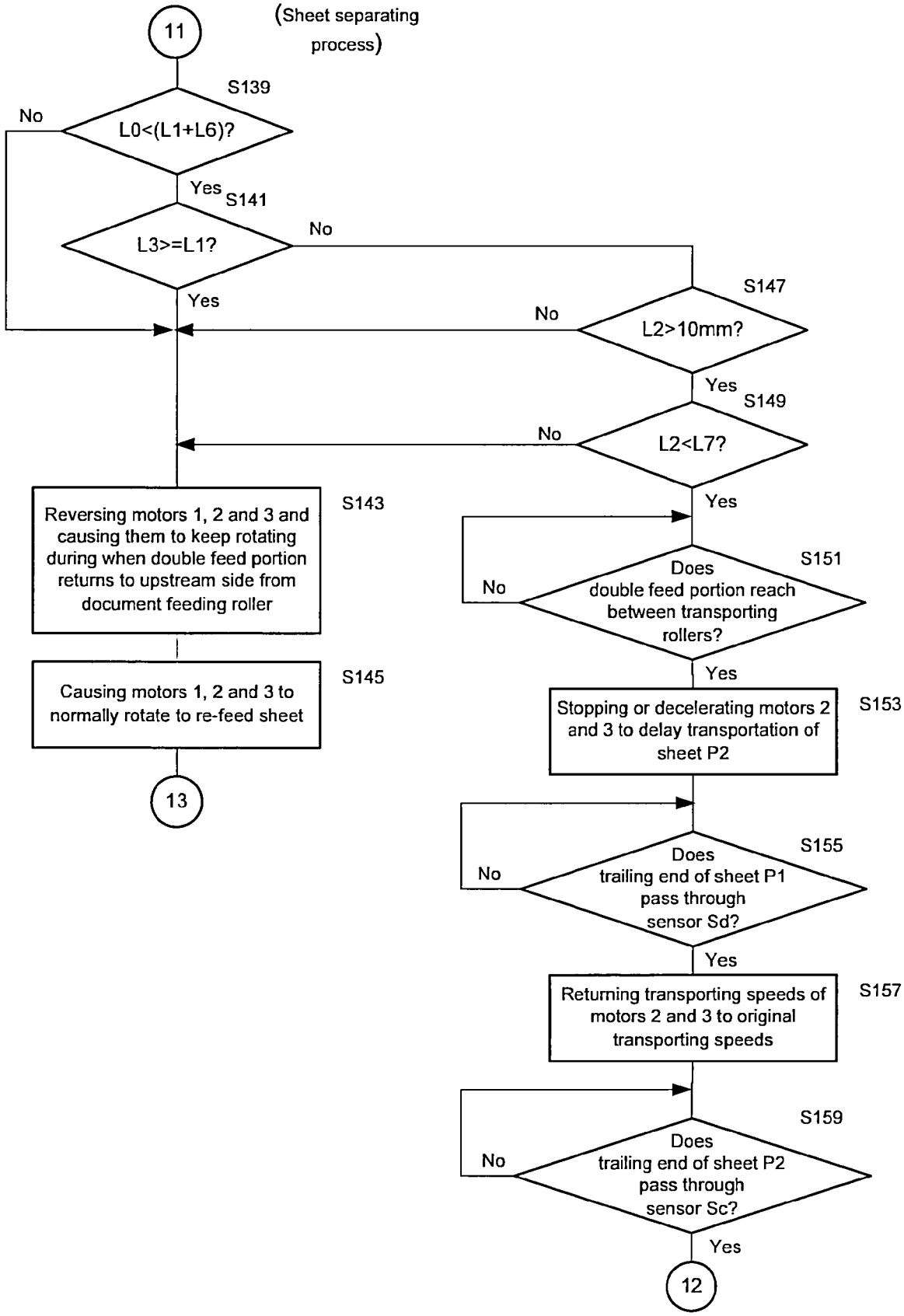
FIG. 11 is a fourth flowchart showing the procedure of the sheet separating process according to the present invention.

The procedure of the sheet separating process executed by the main CPU and sub-CPU will be explained below in detail. FIGS. 8 to 11 are flowcharts showing the procedure of the sheet separating process executed by the main CPU and the sub-CPU. FIGS. 8 and 9 are flowcharts showing the process on the assumption that sheets having different length are mixedly present. These flowcharts mainly represent the procedure of the sub-CPU whose target is a document, but they are not limited thereto. On the other hand, FIGS. 10 and 11 are flowcharts showing the process on the assumption that the length of each sheet is agreed with each other. These flowcharts mainly represent the procedure of the main CPU whose target is a printing sheet of a standard size, but they are not limited thereto. The procedure of the process will be explained below with reference to the flowcharts.

In FIG. 8, when the process for feeding a document is started, the sub-CPU 56 firstly causes the first drive motor 65, second drive motor 63, and third drive motor 58 to rotate normally (step S11). Then, the sub-CPU 56 monitors the document sensor Sa so as to determine whether there is a document on the document tray 27 or not (step S13). When there is no document, the routine proceeds to step S17 where the first drive motor 65, second drive motor 63 and third drive motor 58 are stopped to end the process.

On the other hand, when it is determined at step S13 that there is a document, the sub-CPU 56 excites the pickup solenoid 60 for a predetermined period to lower the pickup arm 55 in order to feed the uppermost sheet. The fed sheet is transported to the document double feed sensor 43 with its leading end passing through the document feeding roller 29.

The sub-CPU 56 repeatedly executes the processes at the following steps S19 to S35 to determine the state of the sheet on the basis of the signal from the document double feed sensor 43 and to control the timers Tc1, Tc2, and Tc3. The above-mentioned process is repeated until the trailing end of the sheet, which is transported without being fed as overlapped, is detected, or until the double feed is detected and the passage of the trailing end of the double feed portion through the document double feed sensor 43 is detected. The repeated process is as follows. Firstly, the sub-CPU 56 determines whether the leading end of the sheet passes or not (step S19). When the passage of the leading end is detected, the timer Tc1 is reset (step S21). Then, it is determined whether the passage of the leading end of the double feed portion is detected or not (step S23). When the leading end of the double feed portion is detected, the timer Tc2 is reset (step S25), and the length L2 from the leading end of the sheet to the double feed portion is calculated (step S27). Then, it is determined whether the passage of the trailing end of the double feed portion is detected or not (step S29). When the trailing end of the double feed portion is detected, the timer Tc3 is reset (step S31), and the length L3 of the double feed portion is calculated (step S33). Then, the routine proceeds to the sheet separating process at step S41 and the following steps. On the other hand, when the trailing end of the double feed portion is not detected at step S29, the routine proceeds to step S35 so as to determine whether the passage of the trailing end of the sheet is detected or not. When the trailing end is detected, the routine proceeds to the step S13 to feed the next sheet. On the other hand, when the trailing end of the double feed portion is not detected at the step S29, the routine proceeds to step S19 to repeat the monitoring of the document double feed sensor 43.

FIG. 9 shows the sheet separating process at step S41 and the following steps. Firstly, the sub-CPU 56 compares the length L3 of the double feed portion and the distance L1 from the upstream document transporting roller 31*a* to the downstream document transporting roller 31*b* (step S47). When L3<L1, the sub-CPU 56 determines whether or not the distance L2 from the leading end of the sheet to the double feed portion is a length to the extent that it can be nipped by the downstream document transporting roller 31*b* and the driven roller 32*b* (step S47). One example of the length is 10 mm, but it is not limited thereto. When L2 is not more than 10 mm, the routine proceeds to step S43 described later to return the sheets P1 and P2 to the document tray 27. When the length L2 is greater than 10 mm, the sub-CPU 56 compares the length L2 and the length L7 (step S49). This is done for determining whether or not the leading end of the sheet P1 goes over the document registration roller 33 when the double feed portion reaches the position between the upstream document transporting roller 31*a* and the downstream document transporting roller 31*b*. When the length L2 is not less than L7, the routine proceeds to step S43 described later to return the sheets P1 and P2 to the document tray 27. On the other hand, when the length L2 is greater than L7, the routine proceeds to step S51 so as to wait until the double feed portion reaches the position between the upstream document transporting roller 31*a* and the downstream document transporting roller 31*b* (step S51). Specifically, like the explanation in FIGS. 6A and 6B, the sub-CPU 56 monitors the timers Tc1 and Tc3, and waits until the timer Tc1 reaches the time corresponding to the length L4 and the timer Tc3 reaches the time corresponding to the length L5. When the timers Tc1 and Tc3 reach the predetermined times respectively, the sub-CPU 56 stops or decelerates the second drive motor 63 and the third drive motor 58 (step S53). Accordingly, the sheet P2 is delayed with respect to the sheet P1, whereby both sheets are separated from each other.

The sub-CPU 56 also monitors the sheet passage sensor Sd, and waits until the passage of the trailing end of the sheet P1 is detected (step S55). The sheet passage sensor Sd is arranged between the downstream document transporting roller 31*b* and the document registration roller 33. When the trailing end of the sheet P1 is detected, the transporting speeds of the second drive motor 63 and the third drive motor 58 are returned to the original transporting speed (step S57). Accordingly, the sheet P2 is transported after the sheet P1 at some intervals. Then, the sub-CPU 56 monitors a sheet passage sensor Sc and waits until the passage of the trailing end of the sheet P2 is detected. The sheet passage sensor Sc is arranged between the upstream document transporting roller 31*a* and the downstream document transporting roller 31*b*. When the trailing end of the sheet P2 is detected, the routine proceeds to step S13 so as to execute the feeding process for the next sheet.

Subsequently, the process at step S43 and the following steps for returning the sheets P1 and P2 to the document tray 27 side will be explained. The routine proceeds to step S43 according to the result of the determination at steps S41, S47 and S49. At step S43, the sub-CPU 56 reverses the first drive motor 65, second drive motor 63 and third drive motor 58. The period of the reverse is defined to be longer than the period obtained by adding the length (L6−L5), i.e., the distance from the document double feed sensor 43 to the document feeding roller 29, to the time indicated by the timer Tc2 at the point of starting the reverse, i.e., the lapse of time from when the leading end of the double feed portion passes through the document double feed sensor 43 to when the reverse is started. It is to be noted that this is when the transporting speed in the normal rotation and the transporting speed of the reverse rotation are equal to each other. When the transporting speed of the normal rotation and the transporting speed of the reverse rotation are different from each other, the reverse time is determined considering the difference in the transporting speed. Accordingly, the double feed portion is returned to the upstream side from the document feeding roller 29. Thereafter, the sub-CPU 56 causes the first drive motor 65, second drive motor 63 and the third drive motor 58 to rotate normally so as to re-feed the returned sheet P1.

Next, a case in which the sizes of the sheets to be fed are equal, and the sheets have the size that can be detected when they are placed on the document tray 27 will be explained. Specifically, the case in which the length of each sheet is found to be L0 before the feeding will be explained. In this case, the sub-CPU 56 can calculate the length L2 from the leading end of the sheet P1 to the leading end of the double feed portion and the length L3 of the double feed portion at the point when the document double feed sensor 43 detects the leading end of the double feed portion. Then, the sub-CPU 56 can execute the sheet separating process according to the result of the calculation. Therefore, the sub-CPU 56 can execute the separation of the sheets without waiting for the detection of the trailing end of the double feed portion.

FIGS. 10 and 11 show the procedure in this case. In FIG. 10, each process at steps S111 to S 121 corresponds to the process at steps S11 to S21 in FIG. 8. For example, the step S111 in FIG. 10 corresponds to the step S11 in FIG. 8 having the last two figures the same as those of the step S111. The same relationship is applied to the other steps. Therefore, the explanation of each step described above is omitted.

At step S123, the sub-CPU 56 determines whether the passage of the leading end of the double feed portion is detected or not. When the leading end of the double feed portion is detected, the sub-CPU 56 resets the timer Tc2 (step S125) so as to calculate the length L2 from the leading end of the sheet to the double feed portion (step S127). The sub-CPU 56 also calculates the length L3 of the double feed portion.

The length L0 of the sheet has already been obtained on the basis of the result of the detection of the document length sensor 39. Further, the length from the leading end of the sheet P1 to the leading end of the double feed portion has already been obtained at the step S127. Therefore, the length L3 of the double feed portion can be calculated by calculating the length L2 from the length L0 of the sheet. Subsequently, the sub-CPU 56 determines whether or not the trailing end of the sheet P2 passes through the document feeding roller 29 before the leading end of the sheet P2 reaches the downstream document transporting roller 31*b* (step S139). Specifically, the sub-CPU 56 compares the length L0 of the sheet P2 and the distance (L1+L6) from the document feeding roller 29 to the downstream document transporting roller 31*b*.

In order to avoid the stay of the sheet at the document feeding roller 29, the sub-CPU 56 returns the sheets P1 and P2 to the document tray 27 for re-feeding when the length L0 of the sheet is not less than the distance (L1+L6). In order to execute this process, the routine proceeds to step S143. The step S143 corresponds to the step S43 in FIG. 8. The step S145 after the step S143 corresponds to the step S45 in FIG. 8. On the other hand, when the length L0 of the sheet is smaller than the distance (L1+L6) from the determination at step S139, the routine proceeds to step S141. The process content at each of steps S141 to S159 corresponds to the process content at each of steps S41 to S59 in FIG. 8.

On the other hand, when the double feed portion is not detected at the step S123, the routine proceeds to step S135 so as to determine whether the passage of the trailing end of the sheet is detected or not. When the trailing end is detected, the routine proceeds to the step S113 so as to feed the next sheet. On the other hand, when the leading end of the double feed portion is not detected at the step S135, the routine proceeds to the step S119 so as to repeat monitoring the document double feed sensor 43.

It is to be noted that, when the explanation is applied to the sheet transporting device at the main body, the document pickup roller 38 may be replaced by the pickup roller 11*a*, the document feeding roller 29 may be replaced by the feeding roller 11*b*, and the document separation roller 30 may be replaced by the separation roller 11*c*. Further, the document double feed sensor 43 may be replaced by the double feed sensor 53, the document transporting roller 31 may be replaced by the transporting roller 51, the driven roller 32 may be replaced by the driven roller 52, and the document registration roller 33 may be replaced by the registration roller 18.

Various modifications are possible for the present invention in addition to the embodiment described above. It should be understood that such modifications also fall within the aspects and scope of the present invention. The present invention is intended to embrace all alterations made within the scope of the invention defined by the appended claims and their equivalents.

What is claimed is:

1. A sheet transporting device comprising:

a sheet feeding section that feeds plural sheets one by one to a transporting path;

a pair of upstream transporting rollers and a pair of downstream transporting rollers that are arranged at the upstream side and the downstream side of the transporting path with a predetermined space, and are driven for transporting sheets;

a double feed detecting section that detects a length of a double feed portion, which is an overlapped portion, of sheets fed in such a manner that another sheet is overlapped with a part of one sheet;

a determining section that determines the length of the double feed portion is shorter than the predetermined space or not; and a transport control section that controls the drives of the pair of the upstream transporting rollers and the pair of the downstream transporting rollers, wherein the transport control section controls the transporting speeds of the pair of the upstream transporting rollers and the pair of the downstream transporting rollers to separate the delaying sheet from the preceding sheet of the overlapped sheets determined by the determining section to have a length of the double feed portion shorter than the predetermined space, while the double feed portion is positioned between the pair of the upstream transporting rollers and the pair of the downstream transporting rollers, and the transport control section controls each of the pairs of the transporting rollers so as to return both the preceding sheet and the delaying sheet to the sheet feeding section and further controls the sheet feeding section so as to re-feed the returned sheets in a case where the length of the double feed portion is not less than the predetermined space.

2. The sheet transporting device according to claim 1, wherein the transport control section further controls the sheet feeding section so as to feed the sheet separated from the preceding sheet after the preceding sheet, and successively feed the next sheet from the sheet feeding section.

3. The sheet transporting device according to claim 1, wherein the transport control section controls to transport the delaying sheet after the preceding sheet at an interval by decelerating or stopping the pair of the upstream transporting rollers.

4. The sheet transporting device according to claim 3, wherein the sheet feeding section includes a sheet separating section for separating one sheet from stacked sheets, and the transport control section decelerates or stops the pair of the upstream transporting rollers after the delaying sheet, which is overlapped with the preceding sheet, passes through the sheet separating section.

5. The sheet transporting device according to claim 3, further comprising a registration roller that is arranged at the downstream side from the pair of the downstream transporting rollers, and temporarily stops the leading end of a sheet to be transported at a predetermined position and feeds the sheet at a predetermined timing , wherein the transport control section decelerates or stops the pair of the upstream transporting rollers before the delaying sheet, which is overlapped with the preceding sheet, reaches the registration roller.

6. The sheet transporting device according to claim 1, wherein the sheet feeding section includes a sheet separating section for separating one sheet from stacked sheets, and the transport control section controls to return the double feed portion of the preceding sheet and the delaying sheet to the upstream side from the sheet separating section.

7. The sheet transporting device according to claim 1, wherein the sheet feeding section includes a sheet separating section for separating one sheet from stacked sheets, and the transport control section controls to return the preceding sheet and the delaying sheet to the upstream side from the sheet separating section.

8. The sheet transporting device according to claim 1, further comprising a size acquiring section for acquiring a size of stacked sheets before the feeding, wherein the double feed detecting section detects the length from the leading end of the preceding sheet to the leading end of the double feed portion, and the determining section calculates the difference between the length of the acquired size in the transporting direction and the length from the leading end of the preceding sheet to the leading end of the double feed portion and defines the difference as the length of the double feed portion.

9. An automatic document feeder provided with the sheet transporting device according to claim 1.

10. An image forming apparatus provided with the sheet transporting device according to claim 1.

* * * * *